US006525708B2

(12) United States Patent
Lin et al.

(10) Patent No.: US 6,525,708 B2
(45) Date of Patent: Feb. 25, 2003

(54) DISPLAY PANEL WITH DOT INVERSION OR COLUMN INVERSION

(75) Inventors: Che-Li Lin, Taipei (TW); Hsien-Ying Chou, Hsinchu (TW)

(73) Assignee: AU Optronics Corporation, Hsinchu (TW)

( * ) Notice: Subject to any disclaimer, the term of this patent is extended or adjusted under 35 U.S.C. 154(b) by 95 days.

(21) Appl. No.: 09/843,100

(22) Filed: Apr. 27, 2001

(65) Prior Publication Data

US 2002/0113768 A1 Aug. 22, 2002

(30) Foreign Application Priority Data

Feb. 20, 2001 (TW) ..... 90103781 A

(51) Int. Cl.[7] ..... G09G 3/36

(52) U.S. Cl. ..... 345/92; 345/96; 345/98; 345/55; 345/211

(58) Field of Search ..... 345/87, 88, 89, 345/92, 93, 94, 95, 96, 98, 99, 100, 211, 55; 349/42, 48, 54

(56) References Cited

U.S. PATENT DOCUMENTS 4,804,951 A * 2/1989 Yamashita et al. ..... 345/94
4,820,222 A * 4/1989 Holmberg et al. ..... 345/93
4,890,097 A * 12/1989 Yamashita et al. ..... 345/93
6,064,363 A * 5/2000 Kwon ..... 345/98

* cited by examiner

*Primary Examiner*—Xiao Wu
(74) *Attorney, Agent, or Firm*—Intellectual Property Solutions, Incorporated

(57) ABSTRACT

The invention is a display panel with dot or column inversion capable of saving power, which uses shunt resistors composed of thin film transistors (TFTs) and an inverter to balance the positive and negative charge or reduce the difference between the positive and negative charge, thereby decreasing power consumption in the switch. The display panel with dot or column inversion capable of saving power includes: an inverter for electrically controlling the operating mode of a display panel; a first plurality of switches connected in series between the display panel and a data driver, to supply power from the data driver to pixels on the display panel; and a second plurality of switches connected in parallel between every two channels with the opposite polarities of the data driver outside the display panel, to construct an equivalent circuit loop according to the operation mode to be selected using the equivalent circuit loop, so as to reach the charge balance on every two channels with the opposite polarities powered by the data driver.

11 Claims, 4 Drawing Sheets

DISPLAY PANEL WITH DOT INVERSION OR COLUMN INVERSION

BACKGROUND OF THE INVENTION

1. Field of the Invention

The invention relates to a display with dot inversion or column inversion, particularly to a display with dot inversion or column inversion capable of saving power by using an equivalent shunt resistor and an inverter to balance the positive and negative charge or reduce the difference between the positive and negative charge, thereby power consumption in the switch.

2. Description of the Related Art

FIG. 1 is a schematic diagram of a typical matrix display. In FIG. 1, the display includes a data driver 11, a scan driver 12, and a display panel 31. As shown in FIG. 1, when the display uses dot or column inversion to correct a flicker effect, the data driver 11 outputs the signal to switch the pixel polarity (with respect to a common electrode (not shown)) on the display panel 31 during the scan driver 12 is on the horizontal time. The inversion used consumes more power as the resolution or the refresh rate is raised. Therefore, the system (not shown) has to provide more power to the data driver, which provides consumption power to the display panel 31, thereby keeping performance at the new higher resolution and higher refresh rates. At this point, energy conservation becomes an important requirement following the technology in progress.

SUMMARY OF THE INVENTION

Accordingly, an object of the invention is to provide a display panel with dot or column inversion capable of saving power, which improves the existing display panel, further saving built-up and reset cost.

The invention is a display panel with dot or column inversion capable of saving power, which uses shunt resistors composed of thin film transistors (TFTs) and an inverter to balance the positive and negative charge or reduce the difference between the positive and negative charge, thereby reducing power consumption in the switch. A display panel with dot or column inversion capable of saving power includes: a first set of switches having two switches; a second switch; and an inverter. Every switch of the first set of switches has a first electrode, a second electrode, and a gate, wherein each of the first electrode is connected to the channel of a respective data driver, and the two gates are connected together. The second switch has a first electrode, a second electrode and a gate. The first electrode of the second switch is coupled between the second electrode of one of the two switches of the first set of switches and the respective channel of the data driver in the display panel. The second electrode of the second switch is coupled between the second electrode of the other of the two switches of the first set of switches and the respective channel of the data driver, opposite the coupled first electrode of the second switch in the display panel. The inverter has a first end and a second end. The first end of the inverter is connected to all gates of the first set of switches and the second end of the inverter is connected to an external signal and the gate of the second switch. The display panel further includes a TFT device connected to the second switch in parallel. The TFT device has a first electrode, a second electrode, and a gate. The first and second electrodes are connected in parallel to the first and second electrodes of the second switch, respectively, and the gate of the TFT device is connected to the second end of the inverter.

The invention is a display panel with dot or column inversion capable of saving power, which uses shunt resistors composed of thin film transistors (TFTs) and an inverter to balance the positive and negative charge or reduce the difference between the positive and negative charge, thereby decreasing power consumption in switch and achieving the purpose of the power save. The display panel with dot or column inversion capable of saving power includes: an inverter for electrically control the operating mode of a display panel; a first plurality of switches connected in series between the display panel and a data driver, to supply power from the data driver to pixels on the display panel; and a second plurality of switches connected in parallel between every two channels with the opposite polarities of the data driver outside the display panel, to construct an equivalent circuit loop according to the operation mode to be selected using the equivalent circuit loop, so as to reach the charge balance on every two channels with the opposite polarities powered by the data driver.

BRIEF DESCRIPTION OF THE DRAWINGS

The aforementioned objects, features and advantages of this invention will become apparent by referring to the following detailed description of a preferred embodiment with reference to the accompanying drawings, wherein.

DETAILED DESCRIPTION OF THE INVENTION

Figure 2:
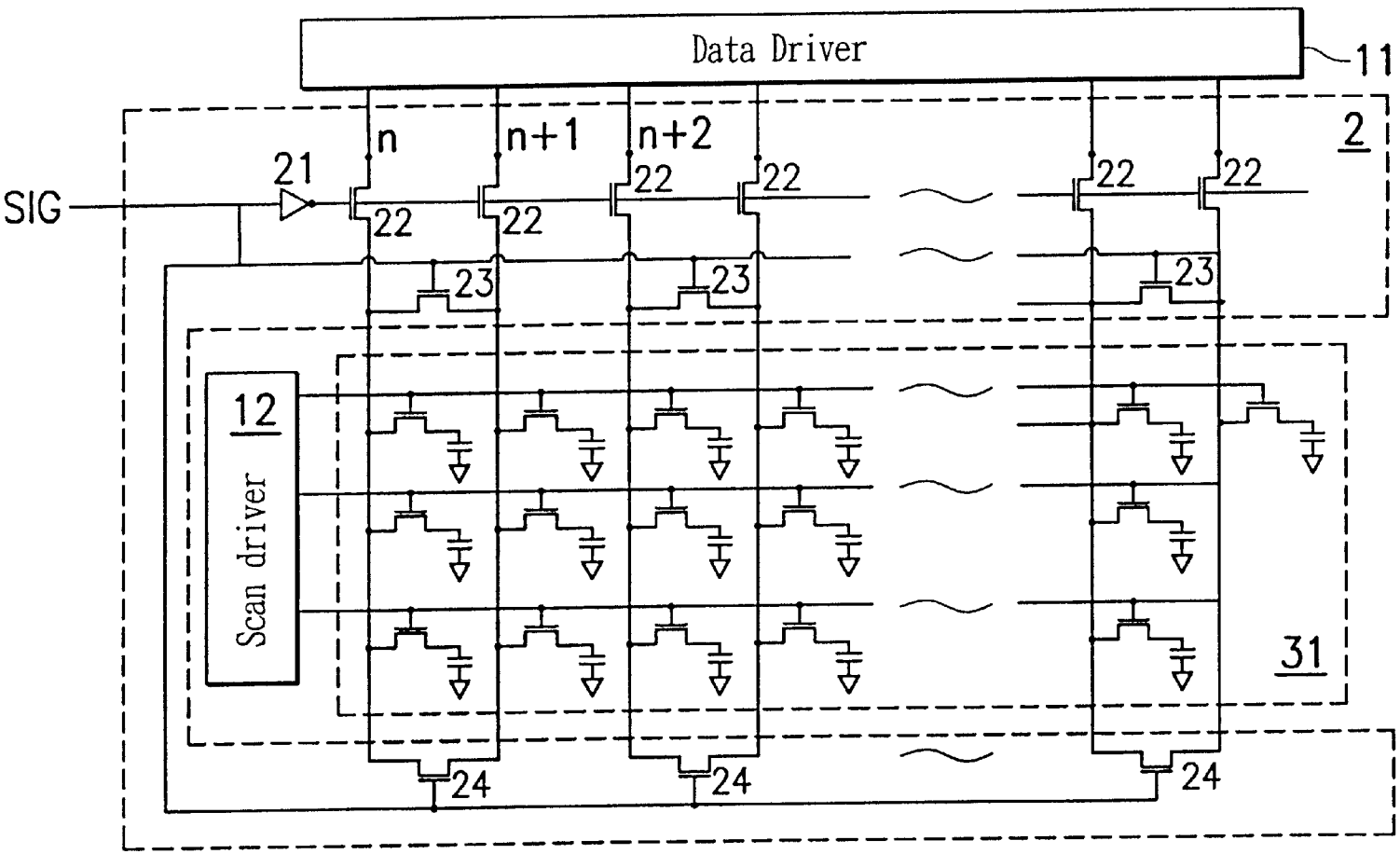
FIG. 2 is a schematic diagram of the display panel drive structure of the invention.
Figure 3:
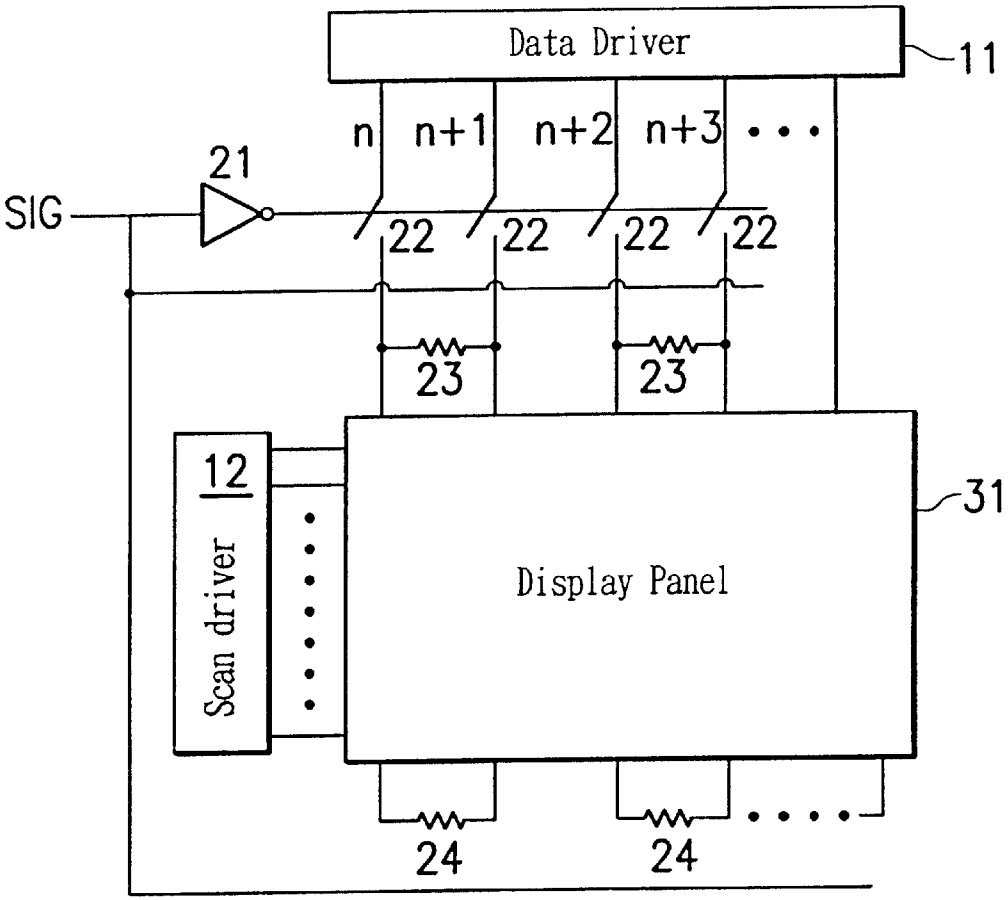
FIG. 3 shows a diagram of the equivalent circuit of FIG. 2.
Figure 4B:
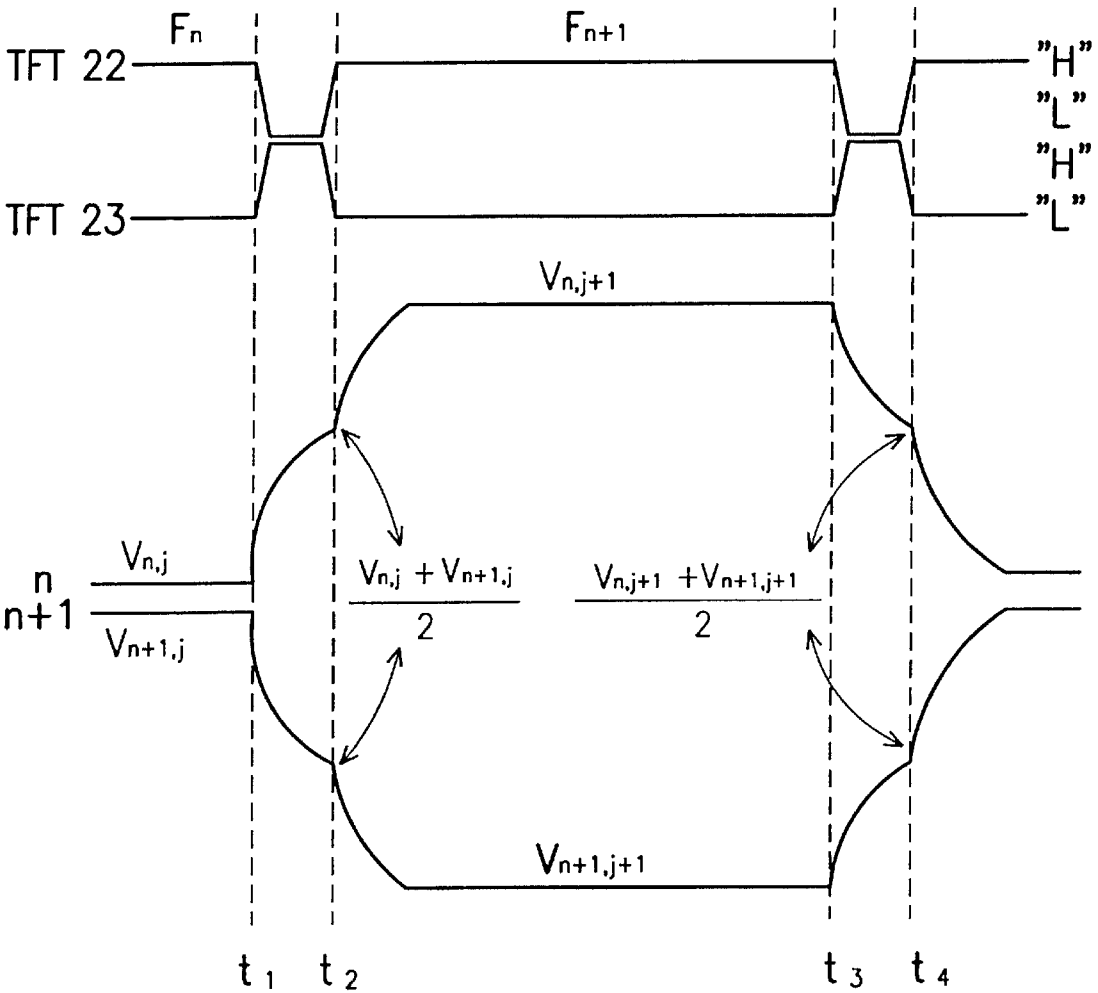
FIG. 4*b* shows a timing diagram of FIG. 4*a*.
Figure 4A:
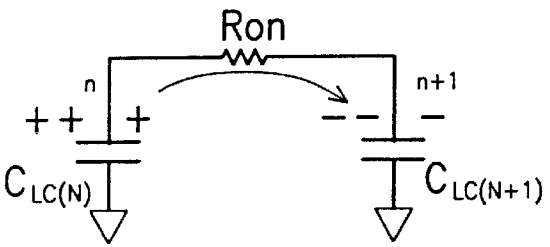
FIG. 4*a* is a diagram of the equivalent circuit of power-saving circuit of the invention.

FIG. 2 is a schematic diagram of a display panel drive structure according to the invention. In FIG. 2, besides the typical display panel drive structure, there is an additional power-saving circuit. The power-saving circuit includes: an inverter 21, a plurality of switches 22, and a plurality of TFT 23 and 24, wherein the inverter 21, a plurality of switches 22, and a plurality of TFT 23 institute a circuit with a flip/flop function. As shown in FIG. 2, when signal SIG is logic 0, the inverter 21 is used as a selector to turn on the switches 22 and off the switches 23. At this point, the display panel 31 acts as a typical display. However, when signal SIG becomes logic 1, the inverter 21 turns off the switches 22 and turns on the switches 23. At this point, referring to FIG. 3, an equivalent circuit capable of saving power is created. In FIG. 3, the active switch 23 acts as a resistor and connected in parallel to the respective TFT device 24 so that the entire resistance of the circuit is reduced, based on the circuit theory. As shown in FIG. 3, the charge is retained with the opposite polarities in the two adjacent channels of the display panel after the dot or column inversion operation through switches 22. The retained charge can balance the charge or reduce the difference between the positive and negative charges in signal switch through reduced resistance. An example follows:

FIG. 4*a* is a diagram of the equivalent circuit of power-saving circuit of the invention. For the purpose of simple description, in FIG. 4*a*, the equivalent circuit with the channels n and n+1 is used as an example. As shown in FIG.

Figure 1:
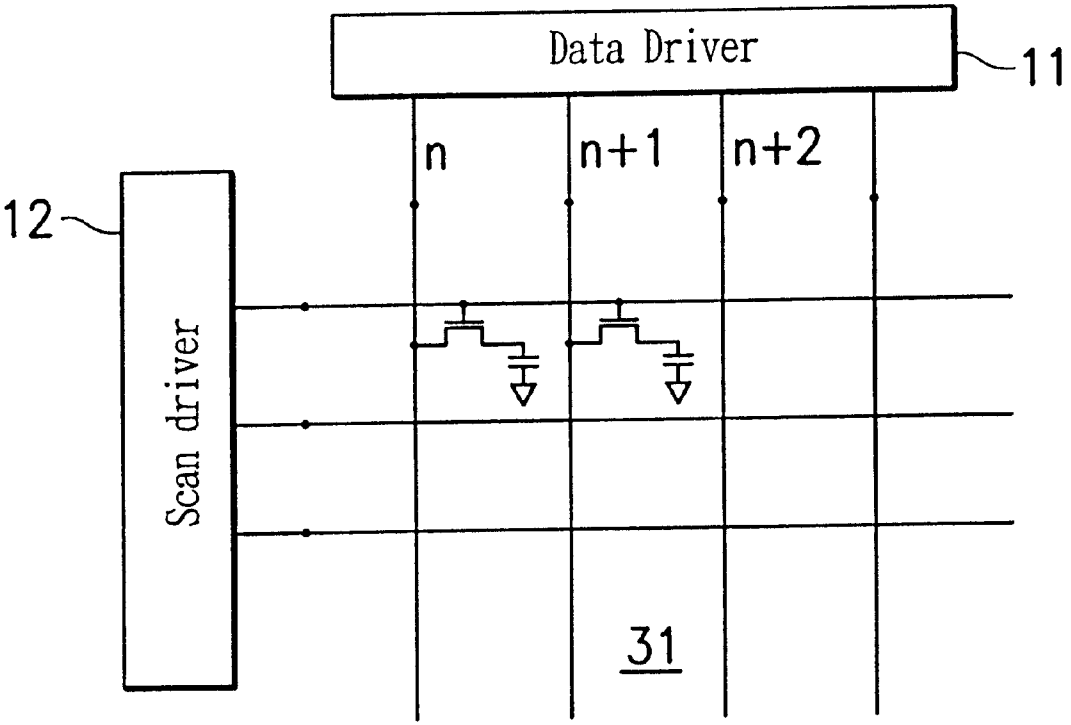
Fig. 1 (Prior Art)
FIG. 1 is a schematic diagram of a typical display panel drive structure.

4*a*, the retained charge in the capacitor $C_{LC(N)}$ of channel n (FIG. 1) is positive, while the retained charge in the capacitor $C_{LC(N+1)}$ of channel n+1 (FIG. 1) is negative. The equivalent resistor Ron, having reduced resistance from the parallel switches 23 and 24, is coupled between the capacitors $C_{LC(N)}$ and $C_{LC(N+1)}$. This creates a voltage difference and causes the positive charge of $C_{LC(N)}$ to move toward the negative charge of $C_{LC(N+1)}$ through the resistor Ron. At this point, a charge balance is created on the resistor Ron. FIG. 4*b* further shows the timing of the charge balance of FIG. 4*a*. As shown in FIG. 4*b*, the switches 22 are turned on and the switches 23 are turned off in the frame $F_n$. At the same time, capacitors $C_{LC(N)}$ and $C_{LC(N+1)}$ have voltages $V_{n,j}$ and $V_{n+1,j}$, respectively. At time $t_1$, the switches 22 are turned off so that the power supplied by the data driver is off, thereby saving power. The switches 23 are concurrently turned on such that the voltages on channels n and n+1 flow begin the charge balance and reach the balance voltage $(V_{n,j}+V_{n+1,j})/2$ at time $t_2$. The dot or column inversion of frame $F_{n+1}$ starts at time $t_2$. Therefore, the switches 22 are turned on and the switches 23 are turned off again. At this point, the voltage of channels n and n+1 is not converted by full amplitude from $V_{n,j}$ and $V_{n+1,j}$ to $V_{n,j+1}$ and $V_{n+1,j+1}$, respectively, as in the prior art. Instead, the invention provides the voltage conversion of channels n and n+1 with half amplitude, i.e., the voltage conversion starts from $(V_{n,j}+V_{n+1,j})/2$ at time $t_2$. At time $t_3$, the charge balance is performed and the channels n and n+1 reach the voltages $V_{n,j+1}$ and $V_{n+1,j+1}$, respectively. Instantly after $t_3$, once TFT 22 is off and TFT 23 is on, charge balance without power supply from driver is created again. Channel n and channel n+1 reach $(V_{n,j+1}+V_{n+1,j+1})/2$ at time $t_4$. Therefore, the time required to supply the power is shortened and the invention saves power.

Although the present invention has been described in its preferred embodiment, it is not intended to limit the invention to the precise embodiment disclosed herein. Those who are skilled in this technology can still make various alterations and modifications without departing from the scope and spirit of this invention. Therefore, the scope of the present invention shall be defined and protected by the following claims and their equivalents.

What is claimed is:

1. A display panel with dot or column inversion capable of saving power, comprising:

a first set of switches having two switches, every switch having a first electrode, a second electrode, and a gate, wherein each of the first electrode is connected to the channel of a respective data driver, and two gates are connected together;

a second switch, having a first electrode, a second electrode and a gate, the first electrode of the second switch coupled between the second electrode of one of the two switches of the first set of switches and the respective channel of the data driver in the display panel, the second electrode of the second switch coupled between the second electrode of the other of the two switches of the first set of switches and the respective channel of the data driver, opposite to the coupled first electrode of the second switch in the display panel; and an inverter, having a first end and a second end, the first end connected to all gates of the first set of switches and the second end connected to an external signal and the gate of the second switch.

2. The display panel of claim 1, further comprising a TFT device, having a first electrode, a second electrode, and a gate, is connected in parallel with the second switch, wherein the first and second electrodes are connected in parallel to the first and second electrodes of the second switch, respectively, and the gate is connected to the second end of the inverter.

3. The display panel of claim 1, wherein the first set of switches are TFT devices.

4. The display panel of claim 1, wherein the second switch is a TFT device.

5. A display panel with dot or column inversion capable of saving power, comprising:

an inverter for electrically controlling the operating mode of a display panel;

a first plurality of switches connected in series between the display panel and a data driver, to supply power from the data driver to pixels on the display panel; and a second plurality of switches connected in parallel between every two channels with the opposite polarities of the data driver outside the display panel, to construct an equivalent circuit loop according to the operation mode to be selected using the equivalent circuit loop, so as to reach the charge balance on every two channels with the opposite polarities powered by the data driver.

6. The display panel of claim 5, further comprising a plurality of devices connected in parallel with the plurality of second switches, respectively, thereby reducing the entire resistance.

7. The display panel of claim 6, wherein the plurality of devices are TFT devices.

8. The display panel of claim 5, wherein the first plurality of switches are TFT devices.

9. The display panel of claim 5, wherein the second plurality of switches are TFT devices.

10. The display panel of claim 5, wherein every two channels with the opposite polarities are two adjacent channels.

11. The display panel of claim 5, wherein every two channels with the opposite polarities are not two adjacent channels.

* * * * *